US006367368B1

(12) United States Patent
Ganster et al.

(10) Patent No.: US 6,367,368 B1
(45) Date of Patent: Apr. 9, 2002

(54) VARIABLE DISPLACEMENT COMPRESSOR HAVING PISTON ANTI-ROTATION STRUCTURE

(75) Inventors: Peter E. Ganster, Plymouth, MI (US); Hew Nam Ahn, Non San (KR)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 09/474,728

(22) Filed: Dec. 29, 1999

(51) Int. Cl.[7] ..... F16J 15/18
(52) U.S. Cl. ..... 92/71; 92/165 PR
(58) Field of Search ..... 92/12.2, 71, 172, 92/165 PR; 417/269

(56) References Cited

U.S. PATENT DOCUMENTS 6,010,313 A * 1/2000 Kimura et al. ..... 92/71 X
6,220,146 B1 * 4/2001 Ota et al. ..... 92/165 PR

FOREIGN PATENT DOCUMENTS

| | | |
|---|---|---|
| JP | 06 346844 | 12/1994 |
| JP | 08 109874 | 4/1996 |
| JP | 09 268975 | 10/1997 |
| JP | 10 082363 | 3/1998 |

* cited by examiner

*Primary Examiner*—John E. Ryznic
(74) *Attorney, Agent, or Firm*—Larry I. Shelton

(57) ABSTRACT

A variable capacity swash plate type compressor (10) incorporates an anti-rotation structure (60) formed on each piston (52). Each piston (52) is disposed in a cylinder (14) of a cylinder block (12). The cylinder block (12) is disposed in a crankcase (18). The anti-rotation structure (60) restricts rotation of a piston (52) within a cylinder (14) by cooperating with an inner surface of the crankcase (18).

6 Claims, 3 Drawing Sheets

VARIABLE DISPLACEMENT COMPRESSOR HAVING PISTON ANTI-ROTATION STRUCTURE

FIELD OF THE INVENTION

The present invention relates to a variable displacement swash plate type compressor adapted for use in an air conditioning system for a vehicle, and more particularly to an anti-rotation structure for pistons disposed in cylinders within the compressor to prevent rotation of the pistons in the cylinders.

BACKGROUND OF THE INVENTION

Variable displacement swash plate type compressors typically include a cylinder block provided with a number of cylinders, a piston disposed in each of the cylinders of the cylinder block, a cylindrical crankcase sealingly disposed on the end of the cylinder block, a rotatably supported drive shaft, and a swash plate. The swash plate is adapted to be rotated by the drive shaft. In addition, the swash plate is operatively connected to a bridge portion of the pistons through shoes. Rotation of the swash plate is effective to reciprocatively drive the pistons. As the swash plate is rotated, frictional forces act laterally on the shoes, which cause the pistons to rotate within the cylinders. Rotation of the pistons must be restricted to prevent contact between the swash plate and the bridge portions of the pistons.

Prior art anti-rotation structures include a winged structure attached to the piston. The ends of the winged structure are designed to contact the inner surface of the crankcase to limit rotation of the piston. The entire winged structure is disposed to extend radially outwardly of the longitudinal axis of the piston from the peripheral surface of the piston. In order to accommodate the winged structure, the diameter of the crankcase must be large.

An object of the invention is to produce a swash plate type compressor having an anti-rotation structure that can be accommodated in a crankcase of a size smaller than the prior art structures.

Another object of the invention is to produce a swash plate type compressor that can be manufactured more economically than the prior art structures, and provide smooth operation and a long service life.

SUMMARY OF THE INVENTION

The above, as well as other objects of the invention, may be readily achieved by a variable capacity swash plate type compressor comprising a cylinder block having a plurality of cylinders arranged radially and circumferentially therein; a crankcase mounted adjacent the cylinder block and cooperating with the cylinder block to define a sealed crank chamber, the crankcase having a central axis and an inner wall with spaced apart longitudinally extending parallel bearing surfaces formed therein and extending parallel to the central axis of the crankcase, the bearing surfaces defining longitudinal recessed portions therebetween; a drive shaft rotatably supported by the crankcase and the cylinder block in the crank chamber; a swash plate slidably and rotatably disposed on the drive shaft; a plurality of pistons reciprocatively disposed in each of the cylinders of the cylinder block, each piston having a longitudinal axis and an outer surface, means for achieving a hinged connection between the swash plate and each of the pistons so that when the drive shaft is rotated, each piston reciprocates in the corresponding cylinder; and an anti-rotation structure disposed on each piston to reciprocatively move within the crankcase, the anti-rotation structure having two shoulder portions extending radially outward from the longitudinal axis of each piston to a point beyond the outer surface of each piston to slide adjacent the raised pads of the inner wall of the crankcase, the shoulder portions of the anti-rotation structure permitting the outer surface of each piston to reciprocatively move adjacent the recessed portions of the inner wall of the crankcase.

BRIEF DESCRIPTION OF THE DRAWINGS

The above, as well as other objects, features, and advantages of the present invention will be understood from the detailed description of the preferred embodiments of the present invention when considered in the light of the accompanying drawings, in which.

DETAILED DESCRIPTION OF THE PREFERRED EMBODIMENT

Figure 1:
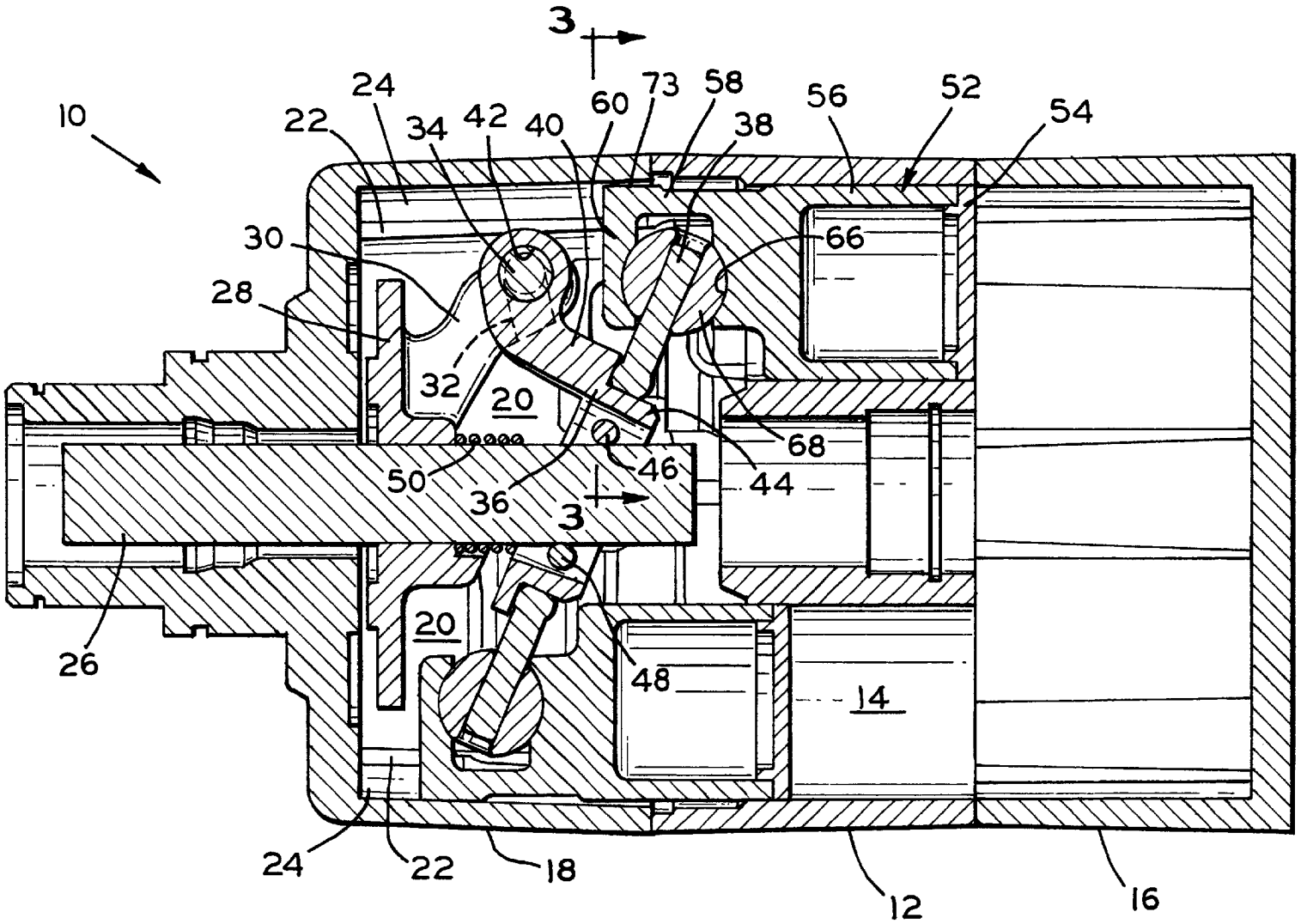
FIG. 1 is a cross sectional view of a variable capacity swash plate type compressor.
Figure 2:
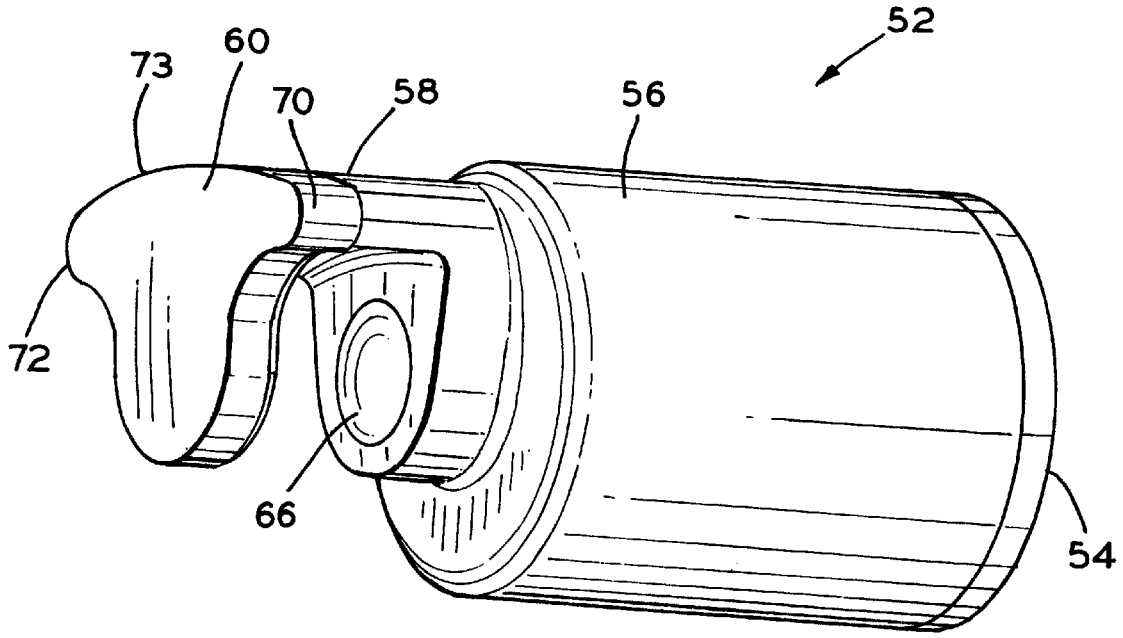
FIG. 2 is a perspective view of a piston from the compressor illustrated in FIG. 1 incorporating the features of the invention.
Figure 3:
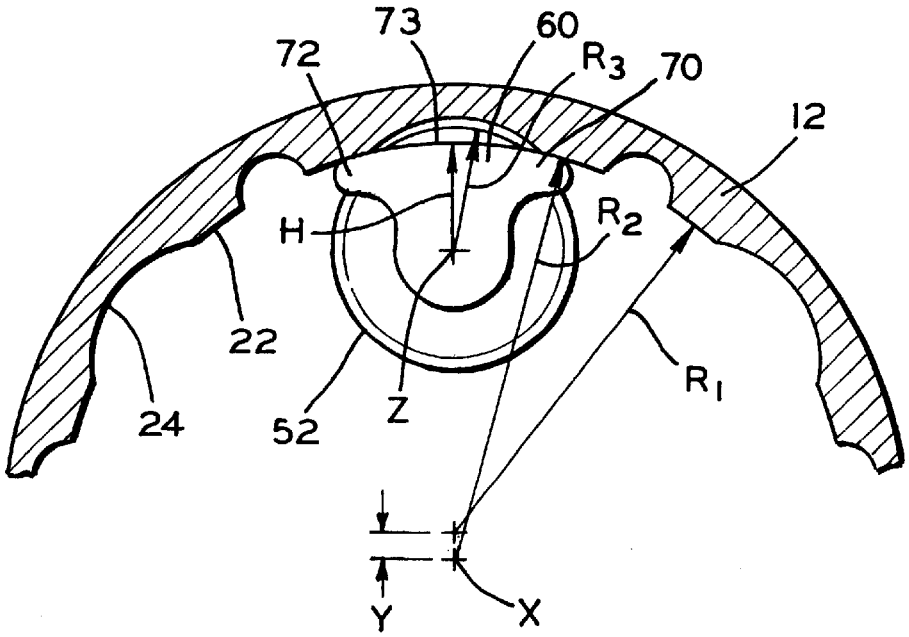
FIG. 3 is a partial fragmentary cross-sectional view of the compressor showing one piston disposed in the crankcase with contact between the anti-rotation structure and bearing surfaces along the inner wall of the crankcase and a gap between the outer wall of the piston and the inner wall of the crankcase taken along line 3—3 of FIG. 1.

A variable capacity swash plate type compressor according to this invention is indicated generally at 10 in FIG. 1. The compressor 10 includes a cylinder block 12 having a plurality of cylinders 14 formed therein. A head 16 is disposed adjacent one end of the cylinder block 12 and sealingly closes the end of the cylinder block 12. A crankcase 18 is sealingly disposed at the other end of the cylinder block 12. The crankcase 18 and cylinder block 12 cooperate to form an airtight crank chamber 20. Longitudinal bearing surfaces 22 are disposed along the inner wall of the crankcase 18, as illustrated in FIGS. 1 and 3. The bearing surfaces 22 are concave with the curvature concentric with a central axis of the crankcase 18. Recessed portions 24 are formed in the crankcase 18 between the bearing surfaces 22. Each recessed portion 24 is aligned with one of the cylinders 14.

A drive shaft 26 is centrally disposed in and arranged to extend through the crankcase 18 to the cylinder block 12. The drive shaft 26 is rotatably supported in the crankcase 18.

A rotor 28 is fixedly mounted on an outer surface of the drive shaft 26 adjacent one end of the crankcase 18 within the crank chamber 20. An arm 30 extends laterally from a surface of the rotor 28 opposite a surface of the rotor 28 that is adjacent the end of the crankcase 18. A slot 32 is formed in the distal end of the arm 30. A pin 34 has one end slidingly disposed in the slot 32 of the arm 30 of the rotor 28.

A swash plate assembly is formed to include a hub 36 and an annular plate 38. The hub 36 includes an arm 40 that extends upwardly and laterally from the surface of the hub 36. The distal end of the arm 40 forms a hole 42. The pin 34, with one end slidingly disposed in the slot 32 of the arm 30 of the rotor 28, has the other end fixedly disposed in the hole 42 of the arm 40 of the hub 36.

A hollow annular extension 44 depends from the opposite surface of the hub 36 as the arm 40. Two pins 46, 48 are disposed in the hub 36 with a portion of the outer surface of the pins 46, 48 exposed in the aperture of the annular extension 44 of the hub 36.

The annular plate 38 has a centrally disposed aperture. The annular extension 44 of the hub 36 extends through the aperture of the annular plate 38. The drive shaft 26 is inserted in the aperture formed by the hub 36 of the swash plate assembly.

A spring 50 is disposed to extend around the outer surface of the drive shaft 26. One end of the spring 50 abuts the rotor 28. The opposite end of the spring 50 abuts the hub 36 of the swash plate assembly.

A plurality of pistons 52 is slidably disposed in the cylinders 14 of the cylinder block 12. Each piston 52 includes a head 54, a hollow middle portion 56, a bridge portion 58, and an anti-rotation structure 60. The middle portion 56 terminates in the bridge portion 58. A pair of concave shoe pockets 66 are formed in the bridge portion 58 of each piston 52 for rotatably supporting a spherical shoe 68, as illustrated in FIG. 1.

The anti-rotation structure 60 includes shoulder portions 70, 72. Preferably, the shoulder portions 70, 72 are symmetrical and mirror images of each other. The shoulder portions 70,72 extend radially outwardly with respect to the longitudinal axis of the piston 52 to a point beyond the outer surface (diameter) of the piston 52. An outer surface 73 of the anti-rotation structure 60, extending between the shoulder portions 70, 72, is curved and concentric with a facing inner wall of the crankcase 18.

As seen in FIG. 3, a radius R1 measured from a longitudinal axis of the drive shaft 26 to the bearing surface 22 of the cylinder block 12 is approximately equal to a radius R2 measured from a point X offset from the longitudinal axis of the drive shaft 26 to the outer surface 73 of the shoulder portions 70, 72. Point X is offset from the longitudinal axis by a distance Y.

A distance H measured from a point Z to an approximate mid-point of the outer surface 73 is less than a radius R3 measured from point Z to an outbound surface of cylinder 14. In other words, a mid-point of the outer surface 73 is radially inbound of the outer diameter of the piston 52.

Figure 4:
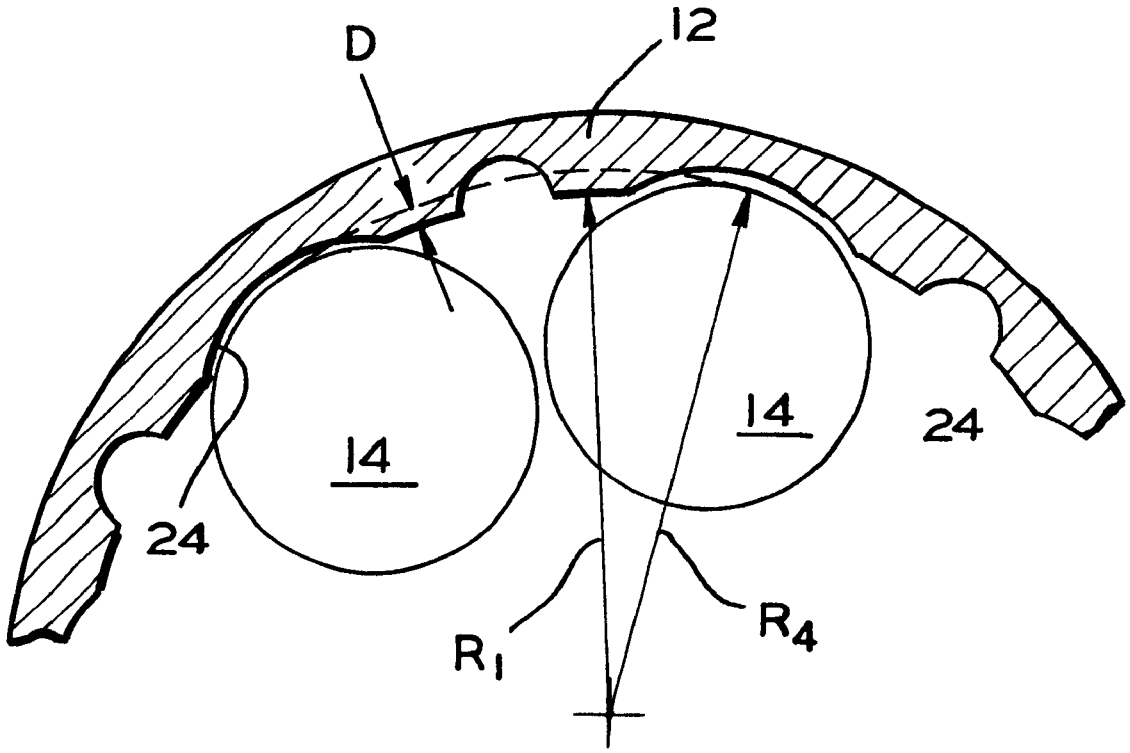
FIG.4 is a view similar to FIG. 3 wherein pistons have been removed from the crankcase to show employ cylinders.

As seen in FIG. 4, the radius R1 is less than a radius R4 measured from the longitudinal axis of the drive shaft 26 to an outbound surface of the cylinder 14.

The diameter of the cylinder block 12 can be reduced by approximately twice the difference D between R3 and R1. This reduction results in a compact compressor 10.

The operation of the compressor 10 is accomplished by rotation of the drive shaft 26 by an auxiliary drive means (not shown), which may typically be the internal combustion engine of a vehicle. Rotation of the drive shaft 26 causes the rotor 28 to correspondingly rotate with the drive shaft 26. The swash plate assembly is connected to the rotor 28 by a hinge mechanism formed by the pin 34 slidingly disposed in the slot 32 of the arm 30 of the rotor 28 and fixedly disposed in the hole 42 of the arm 40 of the hub 36. As the rotor 28 rotates, the connection made by the pin 34 between the swash plate assembly and the rotor 28 causes the swash plate assembly to rotate. During rotation, the swash plate assembly is disposed at an inclination angle. A sliding engagement between the annular plate 38 and the shoe 68 causes a reciprocation of the pistons 52 due to the inclination angle of the swash plate assembly.

The capacity of the compressor 10 can be changed by changing the inclination angle of the swash plate assembly and thereby changing the length of the stroke for the pistons 52. The inclination angle of the swash plate assembly is changed by a control valve means (not shown) used to control the backpressure in the crank chamber 20. When the pressure level in the crank chamber 20 is lowered, a backpressure acting on the respective pistons 52 is decreased, and therefore, the angle of inclination of the swash plate assembly is increased. Namely, the pin 34 connecting the rotor 28 and the swash plate assembly is moved slidably within the slot 32. The swash plate assembly is moved against the force of the spring 50. Therefore, the angle of inclination of the swash plate assembly is increased, and as a result, the length of the stroke of the respective pistons 52 is increased.

Conversely, when the pressure level in the crank chamber 20 rises, a backpressure acting on the respective piston 52 is increased, and therefore, the angle of inclination of the swash plate assembly is decreased. More specifically, the pin 34 connecting the rotor 28 and the swash plate assembly is moved slidably within the slot 32. As a result, the swash plate assembly yields to the force of the spring 50. Therefore, the inclination angle of the swash plate assembly is decreased, and as a result, the length of the stroke of the respective pistons 52 is reduced.

The sliding engagement between the annular plate 38 and the shoes 68 of the pistons 52 causes a lateral force to be exerted on the pistons 52. As the inclination angle of the swash plate assembly is caused to change, the depth the annular plate 38 is inserted into the shoe 68 changes, resulting in a change in the point where the lateral force is exerted on the piston 52. The lateral force tends to cause the piston 52 to rotate about its longitudinal axis. If permitted to rotate, the bridge portion 58 of the pistons 52 would contact the annular plate 38 of the swash plate assembly, thereby restricting rotation of the swash plate assembly and reducing the service life of the compressor 10.

As the piston 52 is rotated, one of the shoulder portions 70, 72 contacts one of the bearing surfaces 22. The contact between the shoulder portions 70, 72 with the bearing surfaces 22 restricts rotation of the piston 52, thereby avoiding contact between the bridge portion 58 of the piston 52 and the annular plate 38.

The recessed portions 24 of the crankcase 18 are curved to permit the outer surface of the pistons 52 to slide adjacent the inner wall of the crankcase 18 without contacting the inner wall of the crankcase 18, thus providing smoother operation of the compressor 10. The recessed portions 24 of the crankcase 18 in cooperation with the bearing surfaces 22 permit the anti-rotation structure 60 to be located radially inward of the outer surface of the pistons 52. Locating the anti-rotation structure 60 in this manner permits a reduction in the overall diameter of the crankcase 18.

By combining the bearing surfaces 22 and the recessed portions 24, material costs are reduced. Machining costs are also reduced. Machining of the bearing surfaces 22 is required due to the contact with the shoulder portions 70, 72. However, since there is no contact between the pistons 52 and the recessed portions 24, no machining of the recessed portions 24 is required.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A variable capacity swash plate type compressor comprising:

a cylinder block having a plurality of cylinders arranged radially and circumferentially therein;

a crankcase mounted adjacent said cylinder block and cooperating with said cylinder block to define a sealed crank chamber, said crankcase having a central axis and an inner wall with spaced apart longitudinally extending parallel bearing surfaces formed therein and extending parallel to said central axis of said crankcase, said bearing surfaces defining longitudinal recessed portions therebetween;

a drive shaft rotatably supported by said crankcase and said cylinder block in said crank chamber;

a swash plate slidably and rotatably disposed on said drive shaft;

a plurality of pistons reciprocatively disposed in each of said cylinders of said cylinder block, each said piston having a longitudinal axis and an outer surface;

means for achieving a hinged connection between said swash plate and each of said pistons so that when said drive shaft is rotated, each said piston reciprocates in a corresponding said cylinder; and an anti-rotation structure disposed on each said piston to reciprocatively move within said crankcase, said anti-rotation structure having two shoulder portions extending radially outward from said longitudinal axis of each said piston to a point beyond said outer surface of each said piston adjacent said bearing surfaces of the inner wall of said crankcase, said shoulder portions of said anti-rotation structure permitting said outer surface of each said piston to reciprocatively move adjacent an associated one of said recessed portions of said inner wall of said crankcase while preventing rotation of said pistons in said cylinders.

2. The compressor defined in claim 1 wherein said bearing surfaces of said crankcase have an arcuate surface concentric with said central axis of said crankcase.

3. The compressor defined in claim 2 wherein said shoulder portions of said anti-rotation structure have an arcuate surface concentric with said central axis of said crankcase.

4. A variable capacity swash plate type compressor comprising:

a cylinder block;

a crankcase having a central axis and an inner wall with spaced apart longitudinally extending parallel bearing surfaces formed therein and extending parallel to said central axis of said crankcase and defining longitudinal recessed portions therebetween;

a drive shaft;

a swash plate;

a plurality of pistons, each said piston having a longitudinal axis and an outer surface and an anti-rotation structure disposed on each said piston to reciprocatively move within said crankcase, said anti-rotation structure having two shoulder portions extending radially outward from said longitudinal axis of each said piston to a point beyond said outer surface of each said piston to slide adjacent said bearing surfaces of said inner wall of said crankcase, and a outer surface spanning between said shoulder portions, wherein a mid-point of the outer surface is radially inbound of the outer diameter of said piston.

5. In a variable capacity swash plate type compressor as defined in claim 4 wherein said bearing surfaces of said crankcase have an arcuate surface concentric with said central axis of said crankcase.

6. In a variable capacity swash plate type compressor as defined in claim 5 wherein said shoulder portions of said anti-rotation structure have an arcuate surface concentric with said central axis of the crankcase.

* * * * *